US005275246A

United States Patent [19]

Krasnov

[11] Patent Number: 5,275,246

[45] Date of Patent: Jan. 4, 1994

[54] DRILL STRING BRIDGE COUPLER AND ACTUATOR

[76] Inventor: Igor Krasnov, 8002 Oakwood Forest Dr., Houston, Tex. 77040

[21] Appl. No.: 900,735

[22] Filed: Jun. 17, 1992

[51] Int. Cl.[5] ..... B23P 19/00; E21B 19/16

[52] U.S. Cl. ..... 175/85; 285/140; 285/333; 285/334.2; 29/426.6

[58] Field of Search ..... 175/85; 29/426.1, 426.5, 29/428, 426.6; 285/140, 333, 334.2, 341, 91

[56] References Cited

U.S. PATENT DOCUMENTS 4,830,121 5/1989 Krasnov et al. ..... 175/57

5,125,148 6/1992 Krasnov ..... 175/85 X

*Primary Examiner*—William P. Neuder

*Attorney, Agent, or Firm*—Frank D. Gilliam

[57] ABSTRACT

A bridge coupling for connecting between a drill pipe and an upper tubular member, such as a kelly cock safety valve in a drill rig and an actuator mechanism for the coupling. The bridge coupling permits rapid and accurate coupling at lower torque levels than with prior couplings. The coupling basically includes a stem having a lower male threaded end adapted to connect with female threads on the upper end of a drill pipe and a threaded upper end adapted to connect with an upper member on a drill rig. A shoulder sleeve surrounds and is secured to the stem intermediate the ends thereof. A spacer sleeve surrounds the stem at the lower stem end, spaced from the shoulder sleeve. A shoulder on a spacer sleeve engages the upper edge of the drill pipe when the drill pipe is threaded onto the stem to low torque, typically by a kelly spinner. An actuator sleeve surrounding the stem and shoulder sleeve is movable to drive a wedge ring between the stem and shoulder ring, tensioning the stem and loading the shoulder engaging the pipe end to provide the required forces locking the pipe in place. A bridge coupler actuator includes an upper fork adapted to engage the stem and a lower fork adapted to engage the actuator sleeve. A hydraulic cylinder system forces the lower fork away from the upper fork to make the connection and toward the upper fork to break the connection. A locking spring ring is provided to lock the connection in the engaged position and prevent accidental opening of the connection under vibration and automatically open when the connection is broken.

17 Claims, 9 Drawing Sheets

DRILL STRING BRIDGE COUPLER AND ACTUATOR

BACKGROUND OF THE INVENTION

This invention relates in general to drill pipe handling apparatus used in oil and gas drilling rigs and, more specifically, to an improved bridge coupler for drill pipe and an actuator therefor.

A wide variety of devices have been used for handling and interconnecting drill pipe in oil and gas drilling rigs over the years. Connections between lengths of pipe must be capable of being made and broken rapidly, positively and safely. The threaded connections between the conventionally threaded pipe ends and a pipe coupler must be made to a high level of torque and must be protected against accidental separation due to the effects of pipe string rotation, vibration and the like. The conventional kelly spinner system used to thread pipe to couplers does not provide the high level of torque required today for direct threaded connections.

Modern high efficiency drilling equipment requires improved couplings. Top drive assemblies of the sort shown in U.S. Pat. No. 4,421,179 and side drive type assemblies of the sort shown in U.S. Pat. 4,875,529 both impart considerable torque to the drive string. These drilling systems permit an operator to drill with a triple stand of pipe, rather than a single stand as with a conventional kelly bushing drill rig. These systems permit a driller to ream the hole as the pipe string is pulling out of, or running into, the hole. During such reaming, the driller rotates the pipe string. This imparts significant torque to the couplings.

When reaming out of the hole, the top connection of each triple stand is broken out high in the derrick, while when running into the hole the top connection must also be made high in the derrick. This requires the make up and break out equipment to be located towards the top of the derrick. Complex or bulky make and break devices, or those requiring high torque, are inconvenient and difficult to provide at that location.

Attempts have been made to provide lower torque couplings for these situations, such as that shown in U.S. Pat. No. 4,658,915. While providing some benefit, these couplings still require substantial torque and do not fully provide effective locking of the made up connection against accidental separation due to vibration or the like. The actuator systems for these couplings is often complex, difficulty to operate and may not provide the required connection reliability.

Thus, there is a continuing need for compact, reliable, pipe coupling systems requiring less torque for making up and breaking connections and providing more reliable connections.

SUMMARY OF THE INVENTION

The above-noted problems, and others, are overcome by the improved bridge coupler of this invention, which basically comprises an elongated stem having threaded upper and lower ends adapted to connect to a drilling pipe, a shoulder sleeve surrounding and fastened to the stem intermediate the ends thereof, a spacer sleeve surrounding the stem at the lower stem end having a shoulder adapted to contact the upper edge of a pipe threaded onto the lower stem end, a wedge ring at least partially around the stem between the spacer sleeve and the shoulder sleeve arranged so that movement of the wedge ring toward the stem forces the shoulder and spacer sleeves apart and forces the spacer sleeve shoulder against the pipe edge. An actuating sleeve assembly is moveable to move the wedge ring toward or away from the stem. A split connector ring connects the shoulder and spacer sleeves.

The actuating sleeve assembly includes an actuating sleeve having a radially tapered inner surface bearing against the wedge ring whereby axial movement of the actuating sleeve along the stem toward the lower stem end causes the inner surface to gradually press the wedge inwardly to bias the shoulder and spacer sleeves apart. Upward movement of the actuating sleeve reverses this action through a tapered key on the inside wall of the actuating sleeve which rides in a split in the wedge ring. A pulling sleeve surrounding the stem above the actuating sleeve is operatively connected to the actuating sleeve so that the system actuator, described below, can move both the pulling and actuating sleeves axially along the stem in either direction.

A locking assembly is provided to automatically lock the pulling and actuating sleeves in the fully engaged position and prevent accidental release due to vibration or the like. The locking assembly can also be manually engaged to further prevent release. A locking ring is provided between the pulling and actuating sleeves. A sloping edge of the locking ring engages a ramp on the pulling ring, permitting the locking ring to move inwardly into engagement with the exterior of the shoulder sleeve when the connection with the pipe is made and away when the connection is broken. Circumferential grooves, in the nature of ratchet teeth, in the abutting faces of the locking ring and shoulder sleeve are in pressure contact when the system is fully actuated, preventing the actuating sleeve assembly from moving along the stem to accidentally open the connection.

An outside lock ring is provided in a partial circumferential slot in the actuating ring. The ring has a radially extending inner cam surface adjacent to the locking ring. Radial movement of the outside lock in one direction moves the cam surface into pressing contact with the outside surface of the locking ring to force the grooved surfaces described above into contact, preventing axial movement of the actuating sleeve system, to positively prevent release of the connection. Movement of the outside lock in the opposite direction releases the actuating sleeve system for normal operation.

An actuator assembly is provided adjacent to the coupler for making and breaking the connection. Basically the actuator includes at least one horizontally moving hydraulic cylinder carrying an upper fork for engaging a circumferential groove in the stem above the actuating sleeve assembly and a lower fork for engaging a circumferential groove in the actuating sleeve assembly. At least one vertically moving hydraulic cylinder moves the second fork vertically toward or away from the first fork.

In operation, the horizontal cylinder brings the forks into contact with their respective grooves after the threaded connection has been made by threading the pipe onto the stem, such as with a conventional kelly spinner. To break a connection, the lower fork is moved upwardly to release the actuating sleeve assembly, with the reverse operation making the connection. Preferably, at least one vertical guide is provided to protect the vertical cylinder(s) from bending forces during operation of the vertical cylinder. If desired the fork moving system may use devices other than hydraulic cylinders, such as lead screws.

In some cases, the kelly spinner rotation may provide sufficient torque on the threads to complete make up of the pipe to coupler connection, so that operation of the actuating sleeve assembly is not required. To accommodate that possibility, a cam is secured to the actuator assembly and a cam follower is secured to the lower fork so that as the forks are retracted horizontally, the cam follow will move the lower fork from the fully "disconnect" position to an intermediate position, leaving available stroke for later both make up and break out of a bridge coupler.

This invention is an improvement on the invention claimed in my copending U.S. Pat. application Ser. No. 07/592,639 filed Oct. 3, 1990.

BRIEF DESCRIPTION OF THE DRAWINGS

Details of the invention, and of certain preferred embodiments thereof, will be further understood upon reference to the drawing, wherein.

DETAILED DESCRIPTION OF PREFERRED EMBODIMENTS

Figure 1:
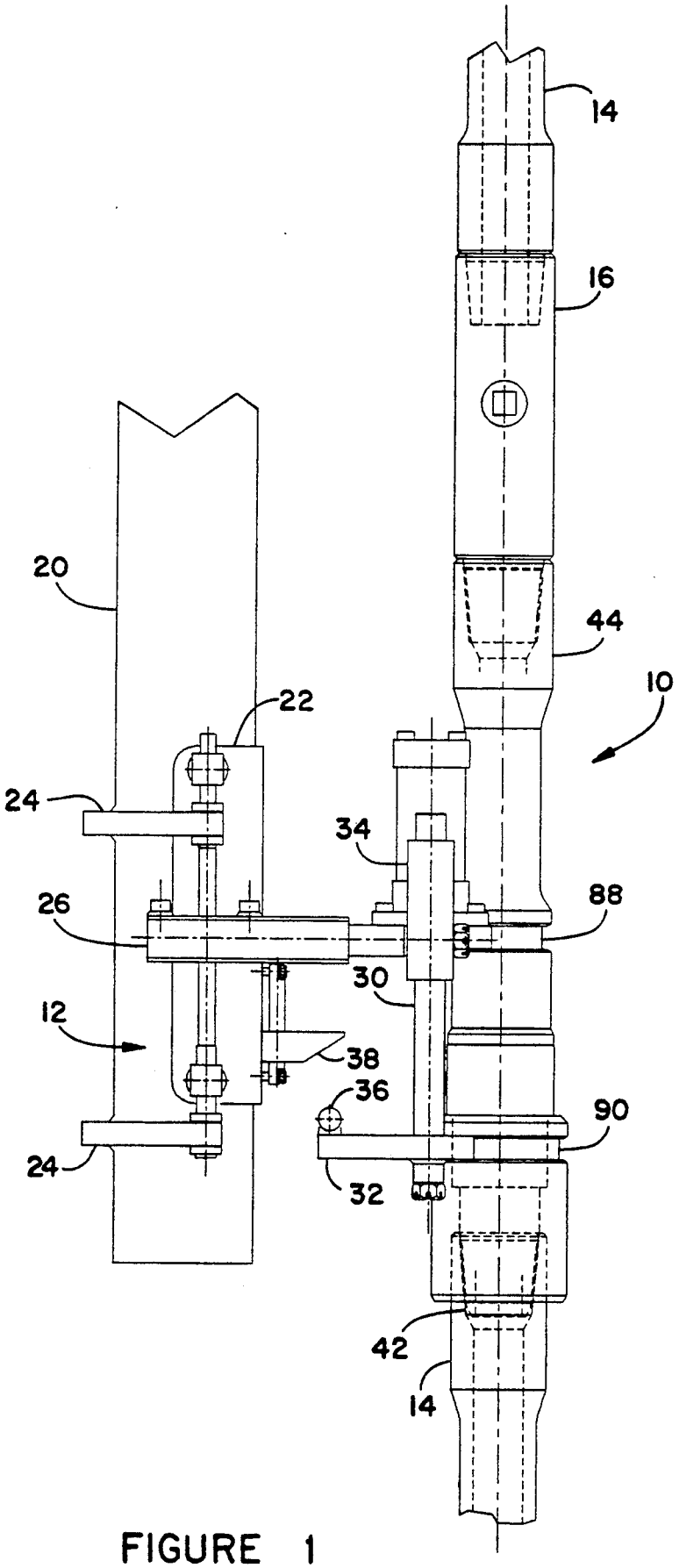
FIG. 1 is a schematic front elevation view of the bridge coupler and actuator of this invention.

Referring now to FIG. 1, there is seen the bridge coupler system 10 in engagement with the coupler actuator system 12. Typically, a drill pipe 14 is threaded onto the lower end of coupler 10 and a kelly safety valve 16 and additional drill pipe 18 are threaded into the upper end of coupler 10.

The actuator system 12 is mounted on a part of the upper assembly 20 at the location where pipe coupling is to be accomplished. Actuator system 12 includes a mounting plate 22 having a generally U-shaped cross section, wrapping partially around the upper assembly component 20 and bolted to brackets 24 welded to derrick component 20. Actuator system 12 includes two parallel horizontal hydraulic cylinders 26 for moving an upper fork 28 into and out of engagement with coupler 10. The configuration of fork 28 is detailed in FIG. 8. Guide rods 30 are mounted on a lower fork assembly 32 and slide through guide sleeves 34 on upper fork 28. Vertical hydraulic cylinders 29 mounted on upper fork 28 move lower fork 32 vertically as needed.

A cam follower 36 and cam surface 38 cooperate to move portions of coupler 10 in certain circumstances, as discussed below in conjunction with the discussion of FIG. 9. Details of actuator assembly 12 are provided below, in conjunction with the discussion of FIGS. 7–8.

Figure 2A:
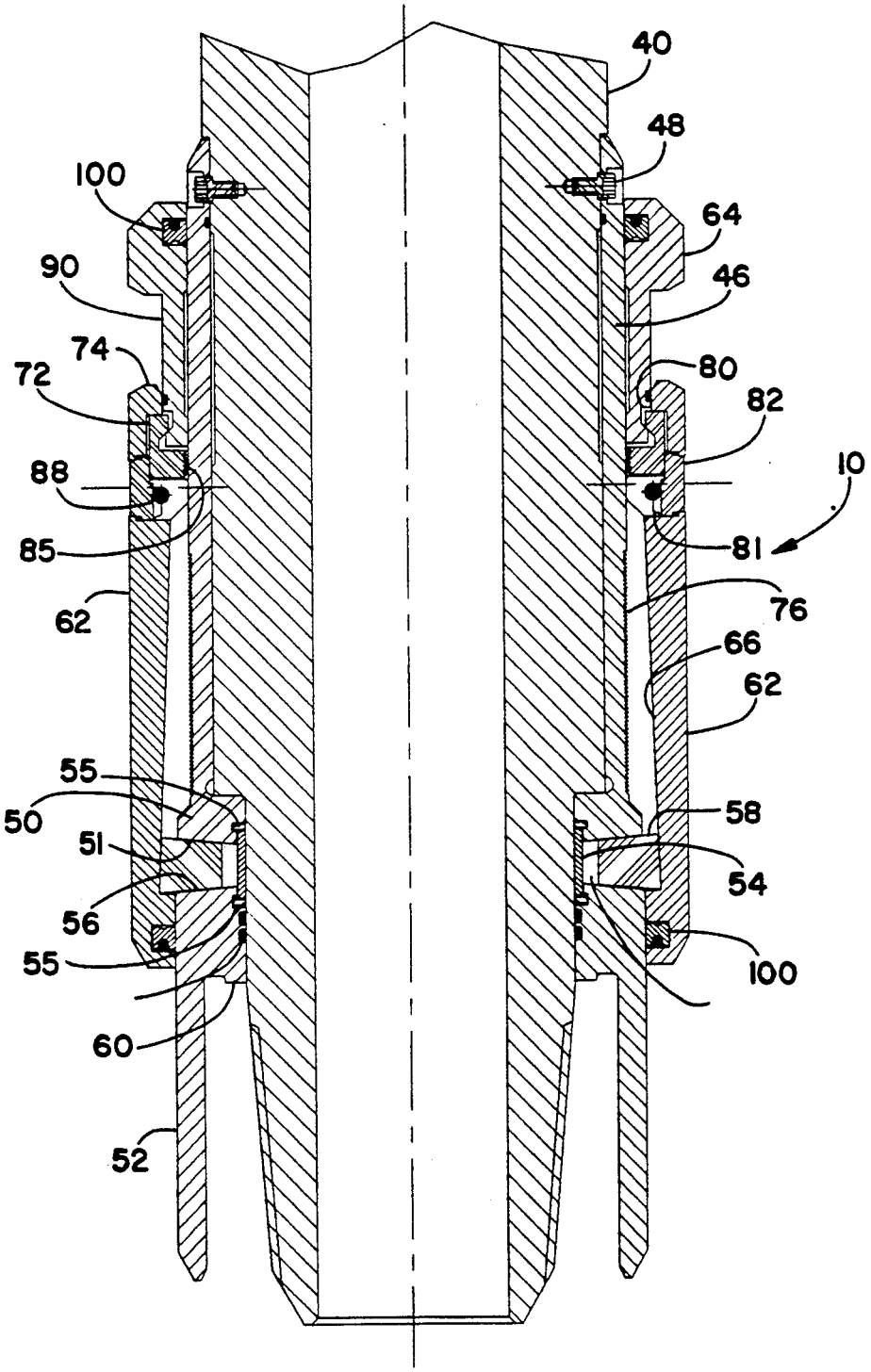
FIG. 2*a* is an axial section view through the lower portion of the bridge coupler of FIG. 1 in the retracted or disconnected position.

Details of the construction and operation of bridge coupler 10 are provided in FIGS. 2*a*–4. FIG. 2*a* shows the system in the retracted or unconnected position and FIG. 2*b* shows the system in the deployed or connected position.

Actuator 10 includes an elongated tubular stem 40 having conventional threads at the lower end 42 for threaded connection to a conventional length of drill pipe 14 (as seen in FIG. 1). The upper end of stem 40 is similarly threaded to connect to a safety valve 16 or lower end of a conventional drill pipe 14 (as best seen in FIG. 1). A shoulder sleeve 46 surrounds a portion of the central region of stem 40 and is secured thereto by bolts 48. The lower end of shoulder sleeve 46 includes a shoulder 50 having a sloping lower surface 51.

Spaced below shoulder sleeve 46 is a spacer sleeve 52 connected to shoulder sleeve by a split connecting ring 54 having shoulders entering into grooves 55 to hold spacer sleeve 52 and shoulder sleeve 52 together in their relative, spaced positions. Spacer sleeve has a sloping upper surface 56 corresponding in angle to surface 51. A split wedge ring having upper and lower surfaces conforming to surfaces 51 and 56 is placed in the space 57 between surfaces 51 and 56. When wedge ring 58 is forced toward the stem axis, spacer sleeve 52 is forced downwardly. Spacer sleeve 52 has an inner shoulder 60 which is in light contact with a drill pipe 14 fully threaded onto lower stem end 42 when wedge ring 58 is in the position shown in FIG. 2*a*. When ring 58 is forced inwardly to the position shown in FIG. 2*b*, spacer sleeve 52 is forced downwardly, bringing shoulder 60 into tight pressure contact with the pipe edge, holding the pipe against accidental unthreading due to pipe string rotation, vibration or the like.

An actuating sleeve 62 surrounds wedge ring 58 and connects to a puller sleeve 64. The inner surface 66 of actuating sleeve 62 is tapered as shown, so that as the sleeve moves downwardly from the position shown in FIG. 2*a* to that shown in FIG. 2*b*, wedge ring 58 is forced further into space 57. In order to assure retraction of wedge ring 58 from space 57 when actuating sleeve 62 is moved from the deployed or connecting position of FIG. 2*b* to the retracted position of FIG. 2*a*, a tapered key 68 is provided on the inner surface of actuating sleeve 62 extending into split 70 as seen in FIG. 3. Tapered key 68 is wider toward the lower end of the coupler, so that as actuating sleeve 62 moves toward the position shown in FIG. 2*a*, the gradually widening key 68 forces the ends of wedge ring 58 apart at split 70 to force wedge ring 58 to move outwardly of space 57.

Figure 2B:
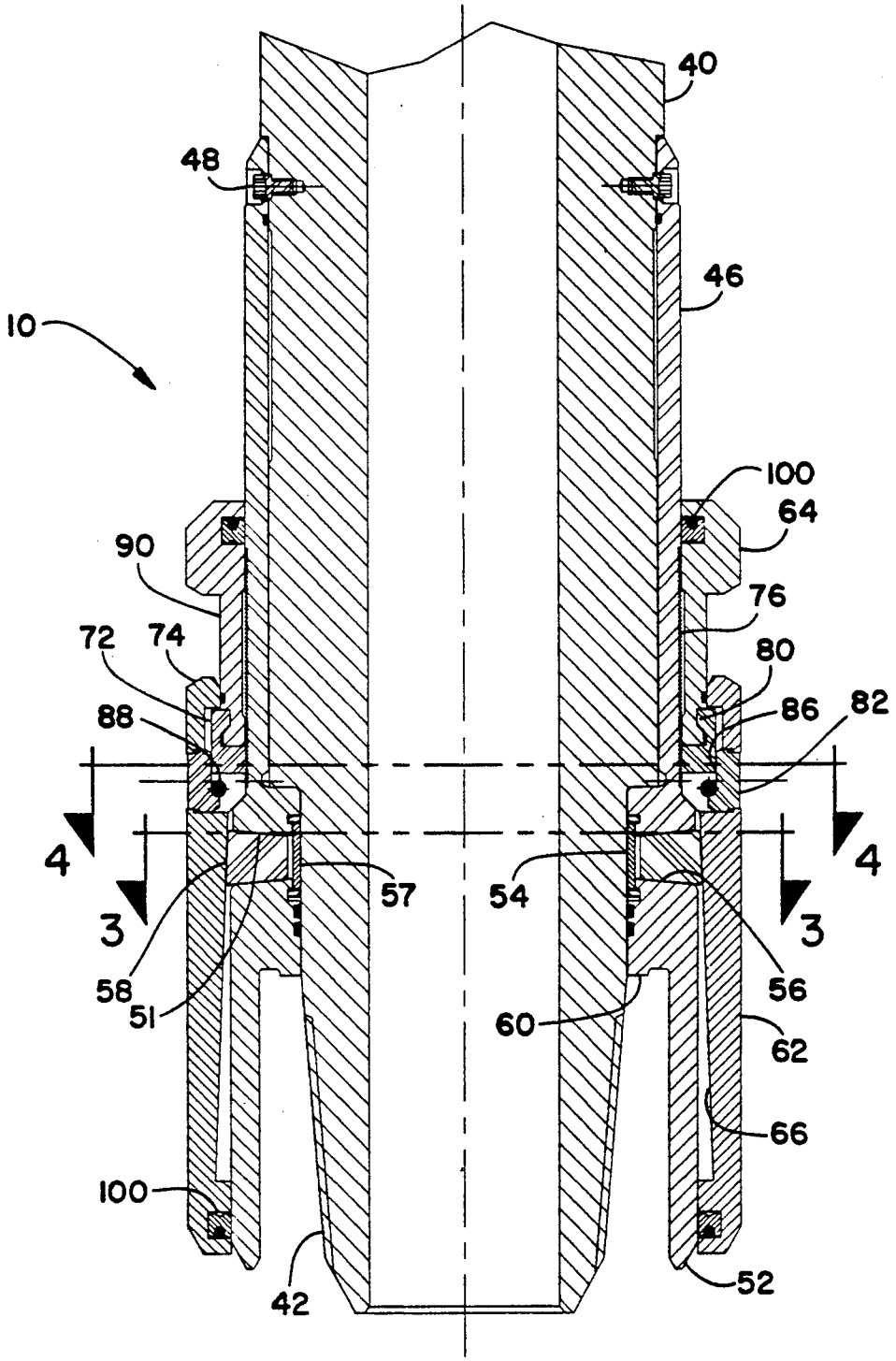
FIG. 2*b* is an axial section view through the lower portion of the bridge coupler of FIG. 1 in the extended or connected position.
Figure 3:
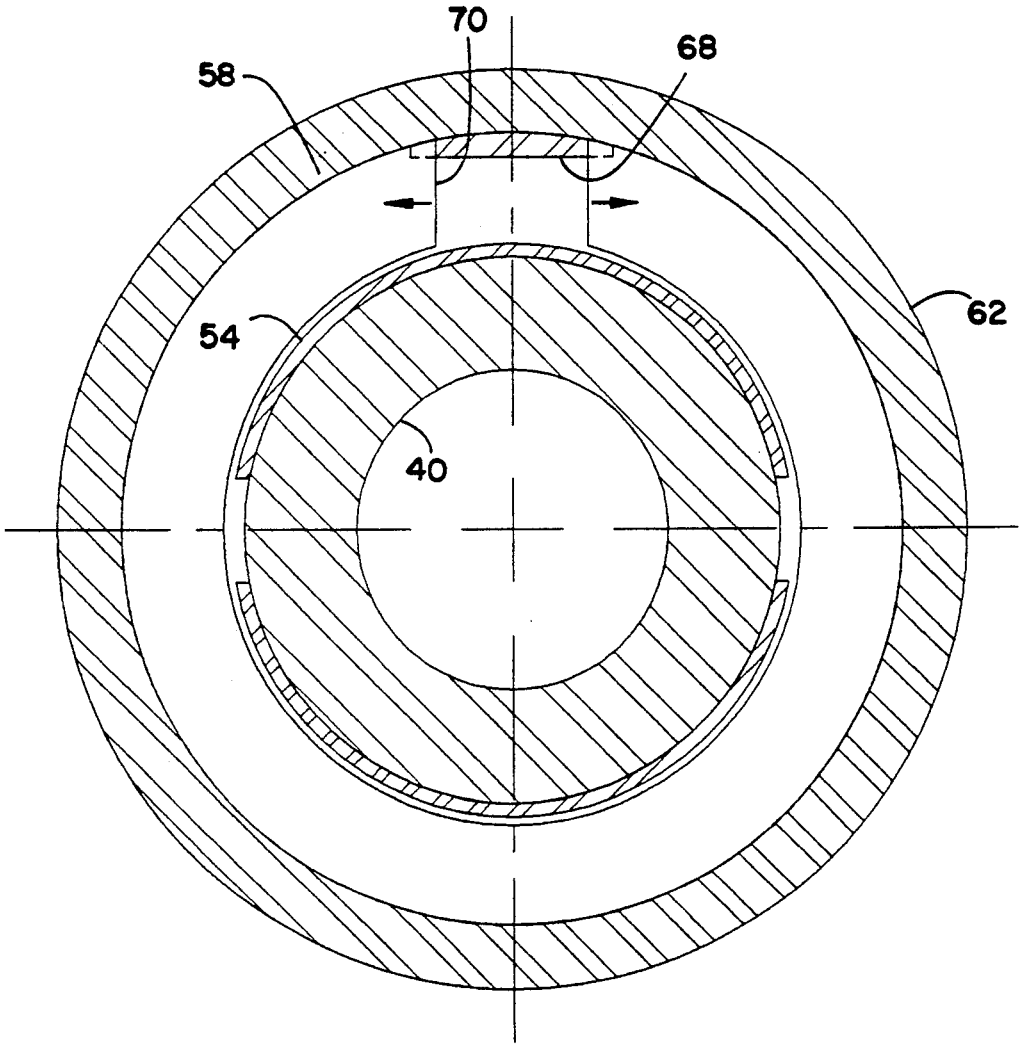
FIG. 3 is a transverse section view taken on line 3—3 in FIG. 2.
Figure 4:
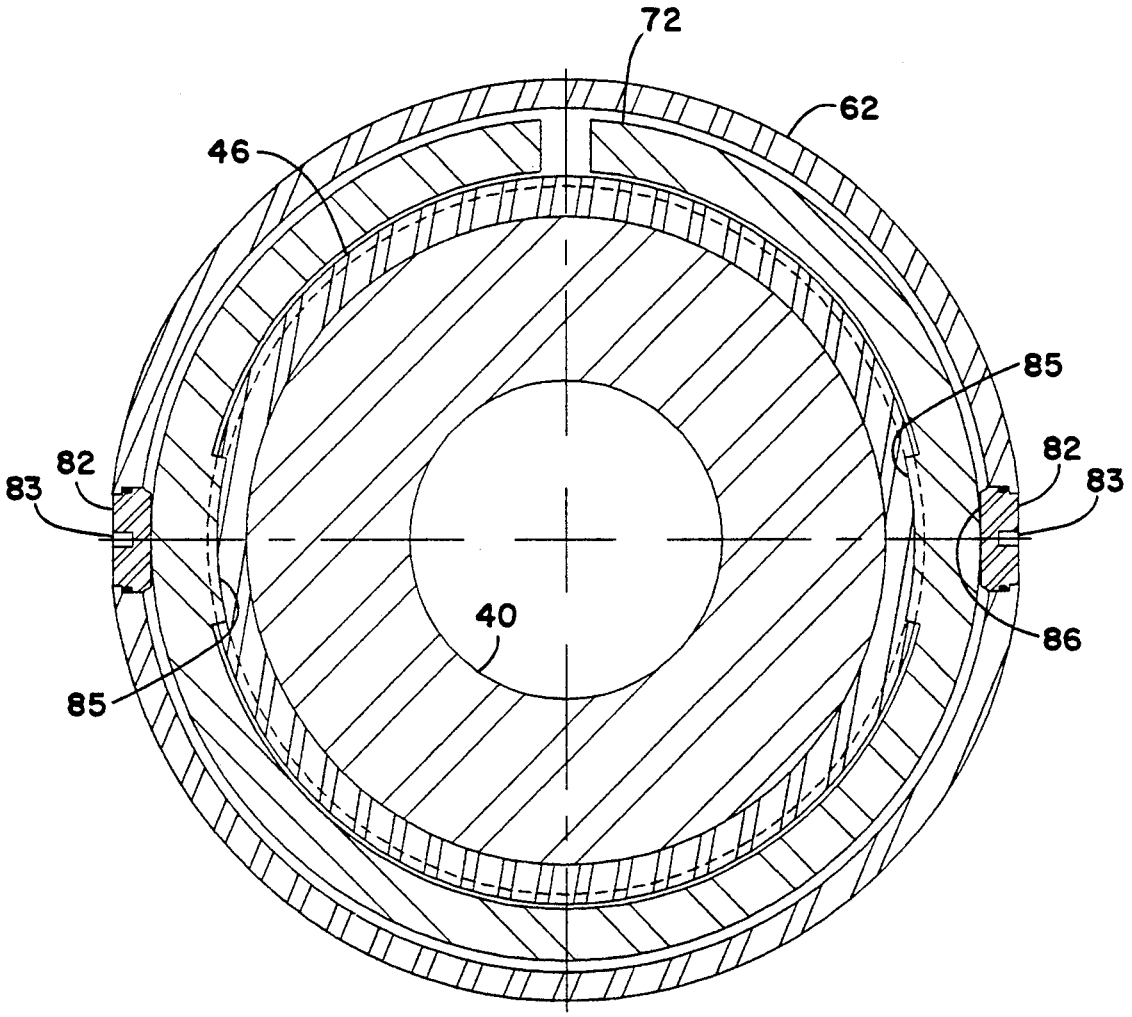
FIG. 4 is a transverse section line taken on line 4—4 in FIG. 2.

An automatic locking mechanism as shown in FIGS. 2*a* and 2*b* assures that the coupler, when connected to a pipe, cannot accidently retract due to rotation of the pipe string, vibration or other causes. A locking spring ring 72 is arranged around the lower end of puller sleeve 64 and is covered by and engages an inward lip 74 on actuating sleeve 62. Locking ring 72 is split and formed from a springy material, biased towards forming a smaller diameter ring.

A portion of the outer surface of shoulder sleeve 46 adjacent to locking ring 72 is provided with surface irregularities to form an anti-slip surface 76. Preferably, this surface has a number of closely spaced small circumferential grooves, in the nature of small ratchet teeth. A similar surface is provided on the inner surface of locking ring 72 adjacent to surface 76.

An inwardly extending lip 78 on locking ring 72 fits into a radial notch 80 in the outer lower end of puller ring 64. The upper abutting surfaces of lip 78 and notch 80 are substantially perpendicular to the axis of stem 40, while the lower abutting surface lie at corresponding downward and outward angles. Thus, as sleeves 64 and 62 move downwardly together to the position shown in FIG. *2b*, puller sleeve 64 allow the spring effect of locking ring 72 to move the anti-slip surfaces into engagement. When the sleeves are moved toward the retracted position of FIG. *2a*, the sloping surface of notch 80 is pressed against lip 78, forcing spring locking ring 72 away from surface 76.

Figure 6:
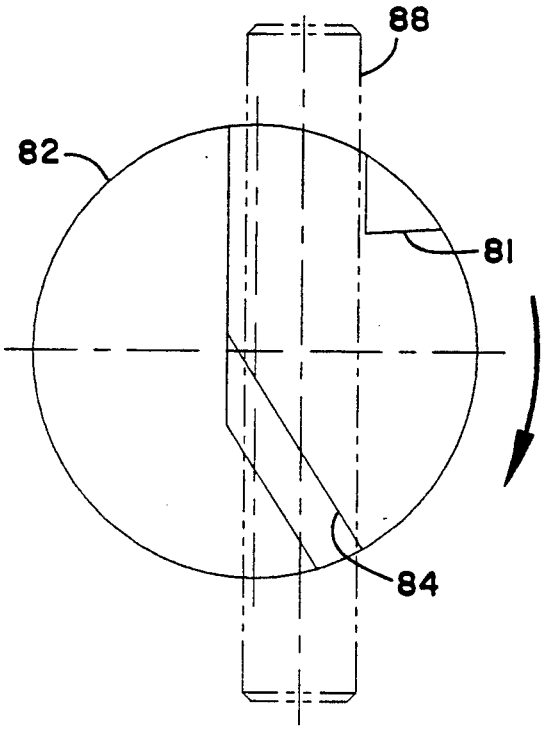
FIG. 6 is a detail plan view of the locking plug of FIG. 5.
Figure 5:
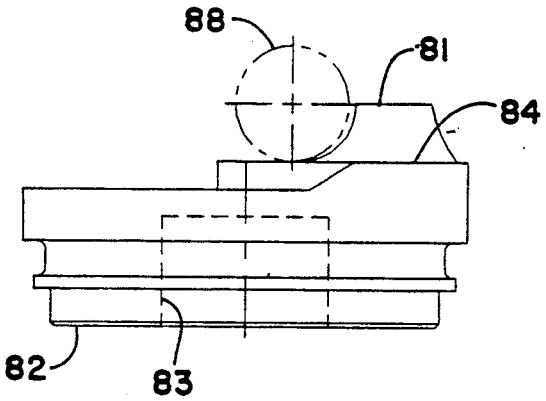
FIG. 5 is a detail elevation view of the sleeve locking plug.

A manual locking means as seen in FIGS. *2a*, *2b* and 4 is also preferably provided for those instances where it is desired to assure that the system cannot inadvertently unthread from the pipe. Locking ring 72 has a cylindrical outside diameter. A pair of plugs 82 are each installed in the wall of actuating sleeve 62 from the inside and held in place by a pin 88 abutting a retainer 81 that crosses the plug surface as best seen in FIGS. 5 and 6 and is secured to sleeve 62 adjacent to the plugs. The pins 88 serve to prevent the plugs from falling into the interior of sleeve 62 during assembly. A screwdriver slot 83 is provided in the outside surface of each plug 82 to permit it to be rotated about 90° . A cam surface is provided on the inside surface of each plug 82 which in a first position is away from ring 72, allowing teeth to disengage from anti-slip surface 76 and in a second position, rotated 90° by a screwdriver in slot 83, the cam surface presses against ring to bring teeth 85 into locking engagement with surface 76.

Figure 7:
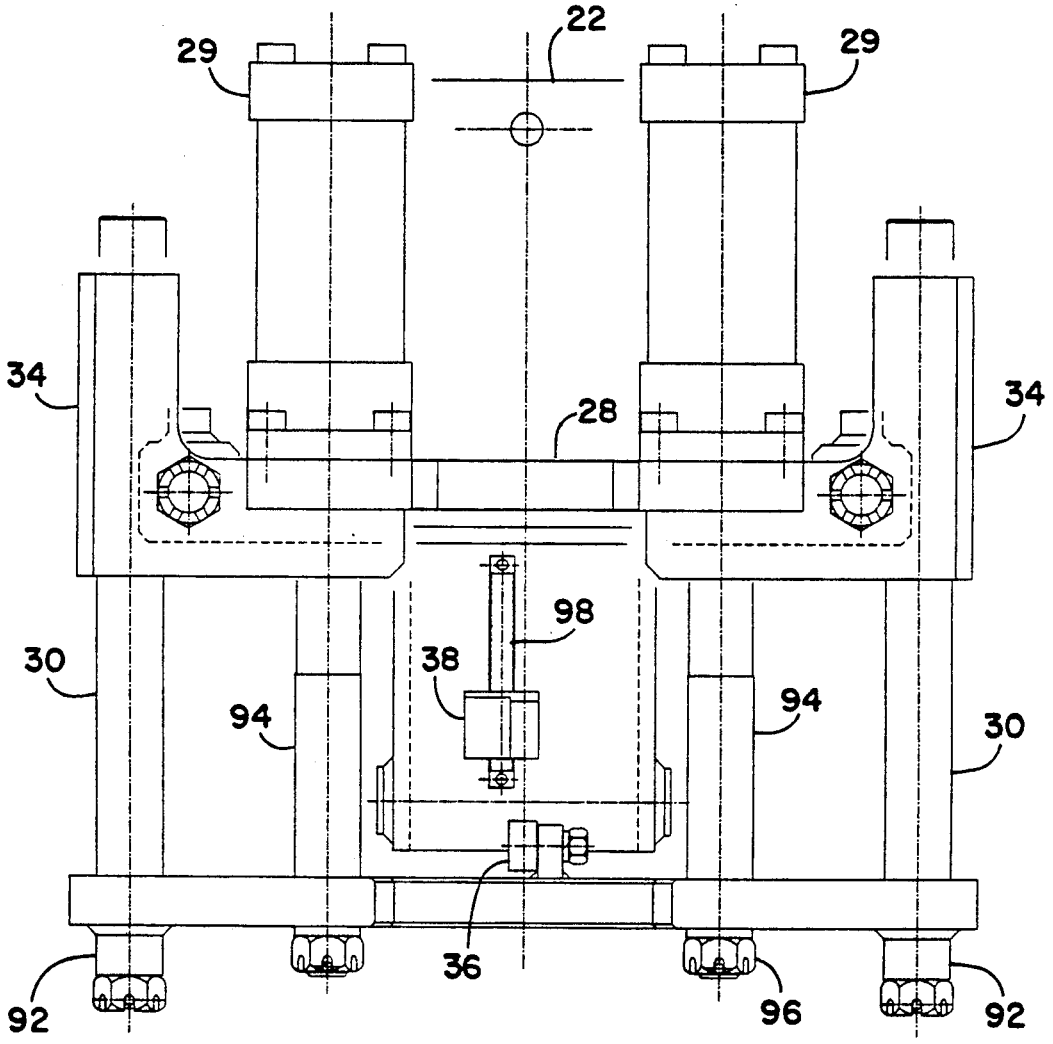
FIG. 7 is a side elevation view of the actuator system.
Figure 8:
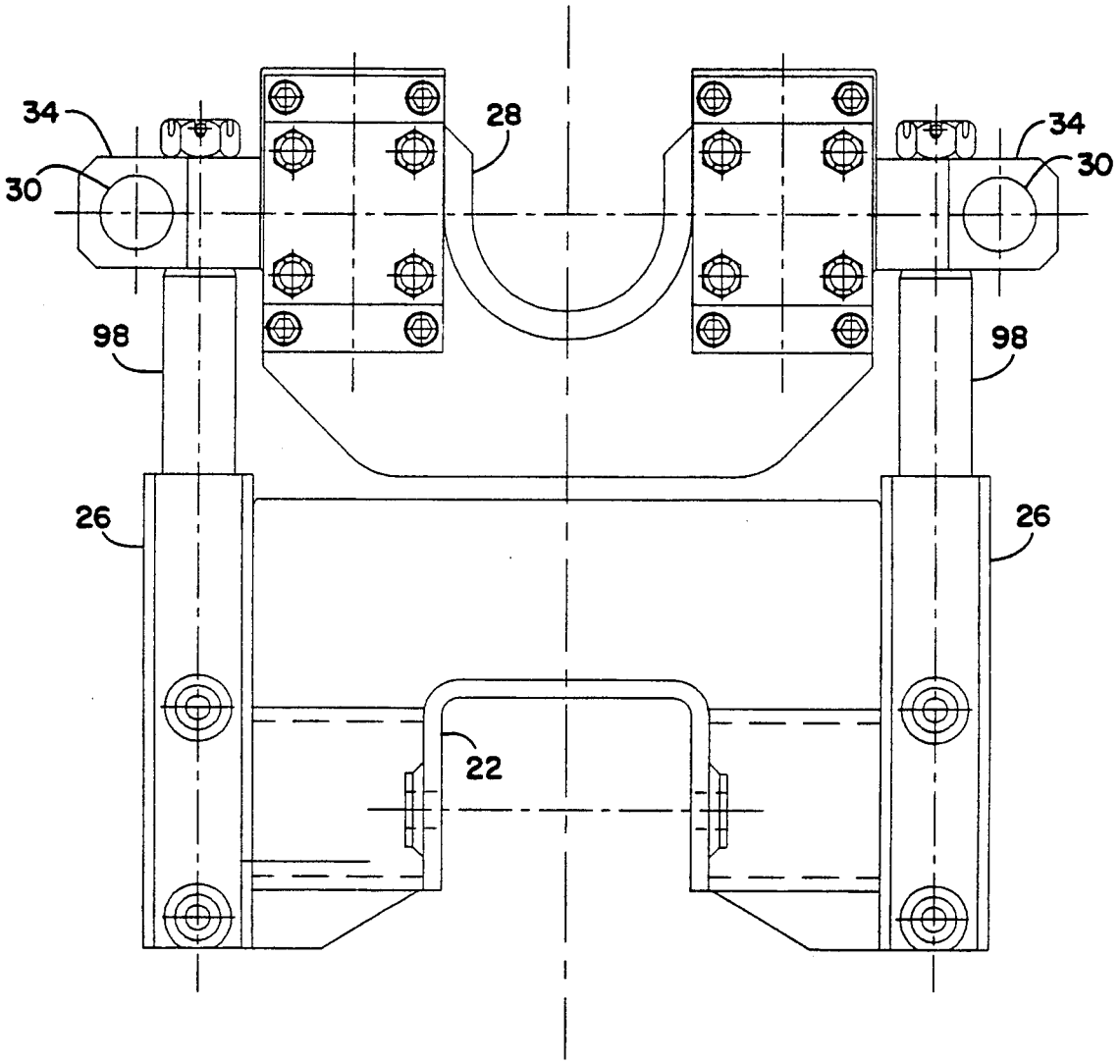
FIG. 8 is a plan view of the actuator system.
Figure 9:
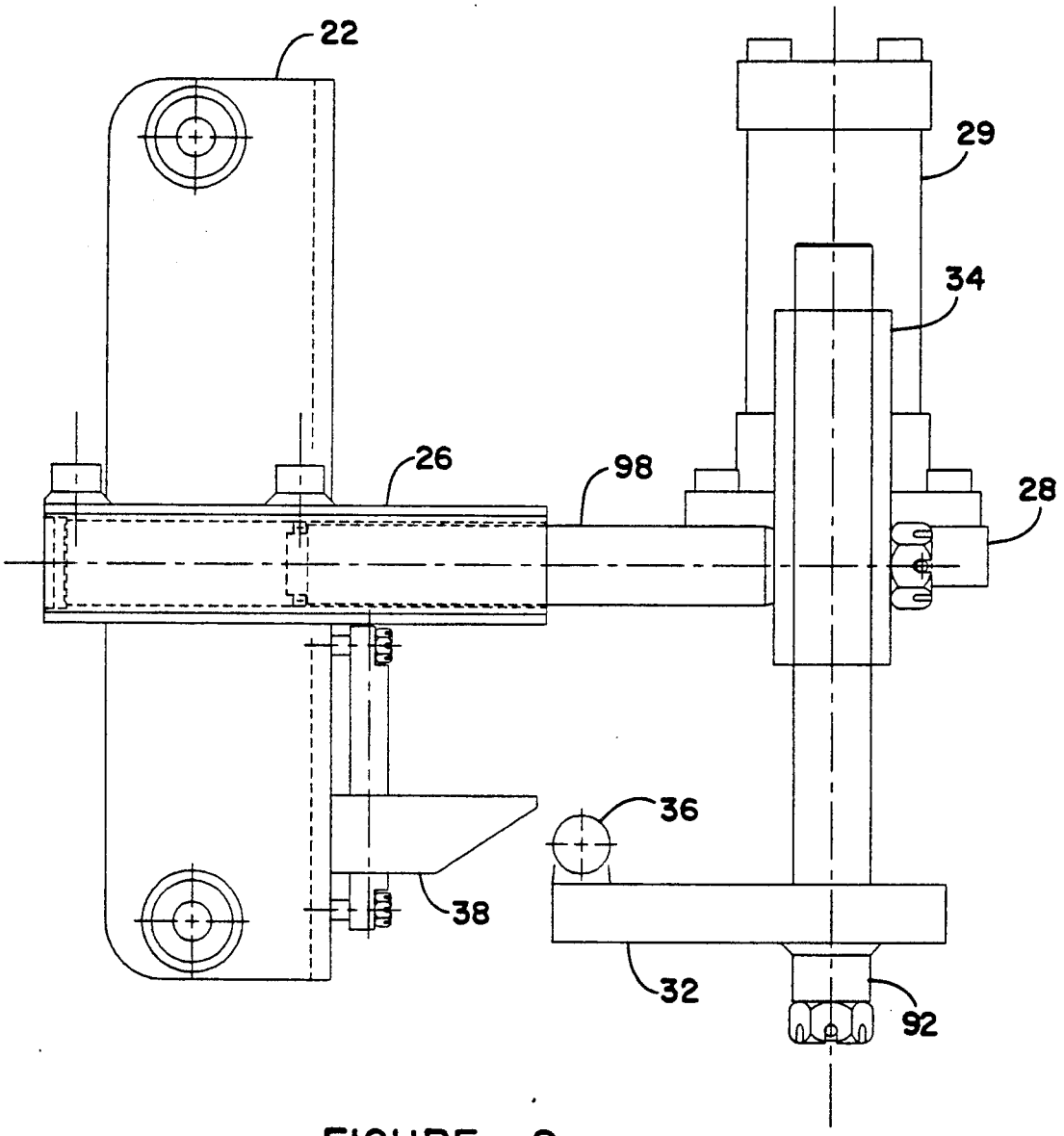
FIG. 9 is a side elevation view of the actuator system in the position for retraction while the coupler is disengaged.

Details of the actuator system 12 are provided in FIGS. 7–9. The vertical hydraulic cylinders 29 mounted on upper fork 28 move lower fork 32 between the retracted and connected positions. Upper fork 28 engages a circumferential groove 88 (FIG. 1) and lower fork 32 engages a similar circumferential groove 90 formed between puller sleeve 64 and actuating sleeve 62 (FIGS. *2a* and *2b*). Guide rods 30 are secured to lower fork 32 by bolts 92 and the ends of the vertical cylinder rods 94 are secured to lower fork 32 by bolts 96.

FIG. 9 shows the vertical cylinder rods 94 fully extended, and FIG. 8,shows the horizontal rods 98 fully extended. FIG. 9 illustrates the horizontal cylinders 26 with rods 98 extended and vertical cylinders 29 retracted.

In some cases, the torque involved in threading a pipe 14 onto stem 40 may be sufficient for complete make up of the drill string. In that case, it may not be necessary to move the actuating sleeve down to the deployed, locking position. If the starting position of the actuating sleeve at the start of the "make up" sequence is at the very top of the stroke, there would be no stroke length left to "break out" the connection; that is, to move the actuating sleeve upwards. To have this safety stroke length available at all times, make up should start somewhere in between the full stroke. A cam system is provided to assure that the actuating sleeve always has some stroke available break out a connection. As best seen in FIG. 9, a cam follower 36 on lower fork 32 will engage a cam face 38 as horizontal cylinder rods 98 are retracted. This will force the lower fork 32 to a downward intermediate position, so that when the horizontal cylinders are next extended the lower fork may be easily moved upwardly or downwardly to a desired position. An adjusting bolt 98 is threaded through the cam so that rotation of bolt 98 will allow precise positioning of cam surface 38 in a preferred position.

A number of seals 100 are provided to prevent contaminants from entering between various closely spaced components.

While certain preferred arrangements and dimensions are described in the description of preferred embodiments, those can be varied, where suitable, with similar results. For example, the apparatus can be formed from any suitable material, although steel is preferred for most components, with titanium preferred for wedge ring 58 due to its modulus of elasticity which is lower than that of steel. Other applications, variations and ramifications of this invention will occur to those skilled in the art upon reading this disclosure. Those are intended to be included within the scope of this invention, as defined in the appended claims.

I claim:

1. A coupler and actuator assembly for connecting to a drill pipe which comprises:

an elongated tubular stem having a lower end adapted to threadedly engage a drill pipe string;

a spacer sleeve surrounding a portion of said stem and movable therealong;

a shoulder on said spacer sleeve adapted to be brought into pressure contact with the upper edge of a pipe threaded onto said stem;

means for moving said spacer sleeve along a line substantially parallel to the axis of said stem between a first position with said shoulder out of contact with said pipe edge and a second position in said pressure contact with said upper edge of said pipe.

2. The bridge coupler and actuator assembly according to claim 1 wherein said means for moving said spacer sleeve comprises;

a wedge ring between a fixed surface on said stem and the edge of said first sleeve away from said shoulder;

said wedge ring tapering toward the stem axis so that movement of said wedge ring toward and away from the stem axis moves said first sleeve toward and away from said pipe edge; and an actuating sleeve assembly surrounding said stem and having a tapered inside surface whereby movement of said second sleeve longitudinally of the stem axis over said wedge ring moves said wedge ring toward and away from the stem axis.

3. The bridge coupler and actuator assembly according to claim 2 wherein said actuating sleeve assembly further includes means for locking said assembly in the position in which said spacer ring assembly is pressed against a pipe edge.

4. The bridge coupler and actuator assembly according to claim 2 wherein said wedge ring is split and said actuating sleeve assembly includes an inwardly and axially extending key extending into said split, said key being tapered in width with the wider end toward the lower stem end, whereby as said actuating sleeve assembly is moved upwardly away from the lower end said wedge ring is expanded and moved outwardly to allow said spacer ring to move away from the pipe edge, relieving pressure on said pipe upper edge.

5. The bridge coupler and actuator assembly according to claim 1 further including actuator means for moving said actuating assembly between the position with the spacer ring shoulder in pressure contact with the end of a pipe threaded onto said stem and the position with said spacer ring shoulder out of contact with said pipe; comprising:

an upper circumferential groove in said stem;

a lower circumferential groove in said actuation assembly;

support means adapted to be positioned adjacent to a coupling installed on a drill pipe;

at least one substantially horizontal extensible means, having an end extensible toward and away from said stem;

an upper fork secured to said horizontally extensible end and adapted to engage said upper groove;

at least one vertical extensible means mounted on said first end, having an and extensible downwardly from said first end, a lower fork secured to said vertically extensible end and adapted to engage said lower groove; and means for moving said lower fork and said actuator assembly between upper and lower positions.

6. A bridge couple and actuator assembly for connecting to a drill pipe which comprises:

an elongated tubular stem having a lower end adapted to threadedly engage a drill pipe string;

a shoulder sleeve secured around said stem intermediate the stem ends;

a spacer sleeve surrounding the lower end of said stem and spaced from said shoulder sleeve;

said spacer sleeve having a shoulder adapted to abut an upper edge of a pipe threaded onto said stem lower end;

a wedge ring in the space between said shoulder sleeve and said spacer sleeve, adapted to move said spacer sleeve toward the lower stem end when said wedge ring is forced inwardly toward the stem axis; and an actuating sleeve assembly comprising:

an actuating sleeve surrounding said spacer sleeve and wedge ring, having a tapered inside wall expanding toward the lower end of said stem; and a puller sleeve surrounding said shoulder sleeve and operative connected to said actuating sleeve to move therewith axially of said stem;

whereby as said puller sleeve is moved toward the lower end of said stem said tapered actuating sleeve surface forces said wedge ring inwardly, expanding the distance between said shoulder sleeve and said spacer sleeve to forcibly drive said spacer ring shoulder against the pipe edge to restrain the pipe against rotation.

7. The bridge coupler and actuator assembly according to claim 6 wherein said wedge ring is split and said actuating sleeve has an inwardly and axially extending key extending into said split, said key being tapered in width with the wider end toward the lower stem end, whereby as said actuating sleeve moves upwardly away from the lower end said wedge ring is expanded and moved outwardly to allow said space between said shoulder sleeve and spacer sleeve to narrow, relieving pressure on said pipe upper edge.

8. The bridge coupler and actuator assembly according to claim 6 further including;

a locking spring ring having an internal surface and said shoulder sleeve having an outer surface, said surfaces being closely spaced and parallel; and means for moving said surfaces into pressure contact when said actuating sleeve is moved toward said lower end of said stem and for moving said surfaces out of contact when said actuating sleeve is moved away from said lower end of said stem;

whereby said actuation sleeve system is locked in place against accidental release.

9. The bridge coupler and actuator assembly according to claim 8 wherein the abutting surfaces of said locking ring and said portion of said shoulder sleeve have a plurality of irregularities so that relative slippage of said locking ring and shoulder sleeve is reduced when those abutting surfaces are in pressure engagement.

10. The bridge coupler and actuator assembly according to claim 9 wherein said irregularities comprise a plurality of circumferential narrow, closely spaced grooves in the nature of ratchet teeth.

11. The bridge coupler and actuator assembly according to claim 8 wherein said means for moving said locking ring into and out of engagement with said portion of said shoulder sleeve comprises:

a radial notch in the outside surface of said puller sleeve extending toward the stem axis adjacent to said locking ring;

a radial lip secured to said locking ring and extending into said notch;

said notch and radial lip each having a corresponding upper surface substantially perpendicular to the axis of said stem; and said notch and radial lip each having a corresponding lower surface extending at an angle outwardly and toward the lower end of said stem;

whereby as said puller sleeve is moved towards the lower position, the surfaces perpendicular to the stem axis engage, driving said locking ring toward said shoulder sleeve and as said puller sleeve is moved away from the lower position, said angled surfaces engage, driving said locking ring away from said shoulder sleeve.

12. The bridge coupler and actuator assembly according to claim 8 further including an outside lock comprising:

a partial ring member lying within a radial slot in said actuator sleeve adjacent to and in contact with said locking ring;

said ring member being movable circumferentially in said slot; and cooperating cam surface means on said contacting surfaces;

whereby rotation of said ring member in a first direction forces said locking ring toward and into contact with said shoulder sleeve and in the second direction permits said locking ring to move out of contact with said shoulder sleeve.

13. The bridge coupler and actuator assembly according to claim 6 further including actuator means for moving said actuating assembly between the position with the spacer ring shoulder in pressure contact with the end of a pipe threaded onto said stem and a position with said spacer ring shoulder out of contact with said pipe; comprising:

an upper circumferential groove in said stem;

a lower circumferential groove in said actuation assembly;

support means adapted to be positioned adjacent to a coupling installed on a drill pipe;

at least one substantially horizontal extensible means, having an end extensible toward and away from said stem;

an upper fork secured to said horizontally extensible end and adapted to engage said upper groove;

at least one vertical extensible means mounted on said first end, having an end extensible downwardly from said first end;

a lower fork secured to said vertically extensible end and adapted to engage said lower groove; and means for moving said lower fork and said actuator assembly between upper and lower positions.

14. The bridge coupler and actuator assembly according to claim 13 further including:

a cam follower secured to said lower end;

a cam surface mounted on said support means; and said cam surface positioned so that if said horizontal extensible means is retracted while said vertical extensible means is in the retracted position, said cam follower will engage and ride along said cam surface to move said actuator assembly to a position intermediate the upper and lower positions.

15. The bridge coupler and actuator assembly according to claim 14 further including means for adjusting the position of said cam surface along a line substantially parallel to the axis of said vertical extensible means.

16. The bridge coupler and actuator assembly according to claim 13 further including at least one vertical guide rod lying substantially parallel to the axis of said vertical extensible means, secured to said lower end and extending through guide sleeves secured to said upper end, to protect said vertical extensible means against bending forces.

17. The bridge coupler and actuator assembly according to claim 13 wherein said horizontal extensible means comprises two substantially parallel hydraulic cylinders and said vertical extensible means comprises two substantially parallel hydraulic cylinders.

* * * * *